US005224311A

United States Patent [19]

Pearce

[11] Patent Number: 5,224,311

[45] Date of Patent: Jul. 6, 1993

[54] TRAILER ANCHOR APPARATUS

[76] Inventor: Charles W. Pearce, 2 Gordons, Pitsea Road, Pitsea, Basilson Essex, United Kingdom, SS13-3DZ

[21] Appl. No.: 790,764

[22] Filed: Nov. 12, 1991

[51] Int. Cl.[5] ..... E04G 25/00; E02D 27/32

[52] U.S. Cl. ..... 52/169.9; 52/23; 52/DIG. 11; 52/146; 248/352

[58] Field of Search ..... 52/169.9, 23, DIG. 8, 52/DIG. 11, 146, 148, 166; 248/352, 354.4, 357

[56] References Cited

U.S. PATENT DOCUMENTS

| | | | |
|---|---|---|---|
| 3,713,259 | 1/1973 | Tkach | 248/352 |
| 3,747,288 | 7/1973 | Grimelii | 52/DIG. 11 |
| 3,754,733 | 8/1973 | Foster | 52/DIG. 11 |
| 3,830,024 | 8/1974 | Warnke | 52/23 |
| 3,848,367 | 11/1974 | Barnes | 52/DIG. 11 |
| 3,881,694 | 5/1975 | Gardner | 52/DIG. 11 |
| 3,884,450 | 5/1975 | Brammer | 52/DIG. 11 |
| 4,125,975 | 11/1978 | Soble | 52/DIG. 11 |
| 4,272,933 | 6/1981 | Lopes | 52/149 |
| 4,420,164 | 12/1983 | Mitchell | 248/352 |
| 4,882,887 | 11/1989 | Gills et al. | 52/DIG. 11 |

*Primary Examiner*—Carl D. Friedman
*Assistant Examiner*—Wynn Wood
*Attorney, Agent, or Firm*—Hugh E. Smith

[57] ABSTRACT

An anchor structure for fixedly securing a mobile home or trailer tongue relative to an underlying ground support is provided, wherein the organization includes respective right and left parallel legs mounted to a base arranged for subsequent mounting in a subterranean orientation relative to the associated trailer, with each leg pivotally mounting a respective right and left pivot leg and the pivot legs arranged for latching an upper and lower support plate relative to one another, wherein the upper and lower support plates each include a mirror image concave semi-cylindrical recess arranged to receive the trailer tongue therethrough. A modification of the invention includes spaced confronting members, each mounted to a central plate arranged for securement, or alternatively bedding within a cementious or other suitable base material.

6 Claims, 4 Drawing Sheets

TRAILER ANCHOR APPARATUS

BACKGROUND OF THE INVENTION

1. Field of the Invention

The field of invention relates to anchor structure, and more particularly pertains to a new and improved trailer anchor apparatus wherein the same is arranged for mounting a trailer tongue relative to a ground support in a secure manner to accommodate the trailer in a stable relationship relative to the underlying ground support surface.

2. Description of the Prior Art

Trailers, and more particularly mobile homes, are mounted in fixed orientations for their use and typically such homes are subject to winds, floods, and other conditions adversely effecting stability of the trailer structure. Prior art anchors to secure such trailers have in the past been of an elaborate and expansive structure limiting their use. Such prior art is exemplified in U.S. Pat. No. 4,882,887 to Giles wherein a support plate is arranged for mounting a mobile home structure thereon.

U.S. Pat. No. 4,294,053 to Lopes sets forth a mobile home anchor utilizing adjustable chain link member, with an anchor pin mounted within a cementious base.

U.S. Pat. No. 4,023,314 to Tanner sets forth a mobile home anchor mounted within an expanding lower anchor portion arranged for embedding within a subterranean cementious environment.

As such, it may be appreciated that there continues to be a need for a new and improved trailer anchor apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of trailer anchor apparatus now present in the prior art, the present invention provides a trailer anchor apparatus wherein the same provides for a yoke member arranged for pivotally supporting confronting support plates securing a mobile home trailer tongue therethrough. As such, the general purpose of the present invention, which will be described subsequently in greater detail, is to provide a new and improved trailer anchor apparatus which has all the advantages of the prior art trailer anchor apparatus and none of the disadvantages.

To attain this, the present invention provides an anchor structure for fixedly securing a mobile home or trailer tongue relative to an underlying ground support, wherein the organization includes respective right and left parallel legs mounted to a base arranged for subsequent mounting in a subterranean orientation relative to the associated trailer, with each leg pivotally mounting a respective right and left pivot leg and the pivot legs arranged for latching an upper and lower support plate relative to one another, wherein the upper and lower support plates each include a mirror image concave semi-cylindrical recess arranged to receive the trailer tongue therethrough. A modification of the invention includes spaced confronting members, each mounted to a central plate arranged for securement, or alternatively bedding within a cementious or other suitable base material.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved trailer anchor apparatus which has all the advantages of the prior art trailer anchor apparatus and none of the disadvantages.

It is another object of the present invention to provide a new and improved trailer anchor apparatus which may be easily and efficiently manufactured and marketed.

It is a further object of the present invention to provide a new and improved trailer anchor apparatus which is of a durable and reliable construction.

An even further object of the present invention is to provide a new and improved trailer anchor apparatus which is susceptible of a low cost of manufacture with regard to both materials and labor, and which accordingly is then susceptible of low prices of sale to the consuming public, thereby making such trailer anchor apparatus economically available to the buying public.

Still yet another object of the present invention is to provide a new and improved trailer anchor apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an isometric illustration of a modification of the invention.

DESCRIPTION OF THE PREFERRED EMBODIMENT

Figure 1:
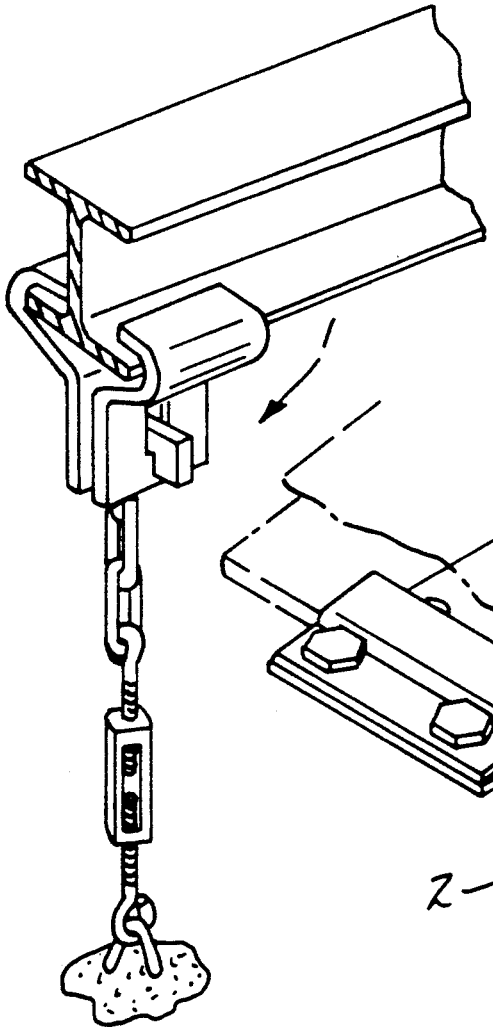
Fig 1 PRIOR ART
FIG. 1 is an isometric illustration of a prior art trailer anchor structure.

With reference now to the drawings, and in particular to FIGS. 1 to 7 thereof, a new and improved trailer anchor apparatus embodying the principles and concepts of the present invention and generally designated by the reference numerals 10 and 10*a* will be described.

Figure 2:
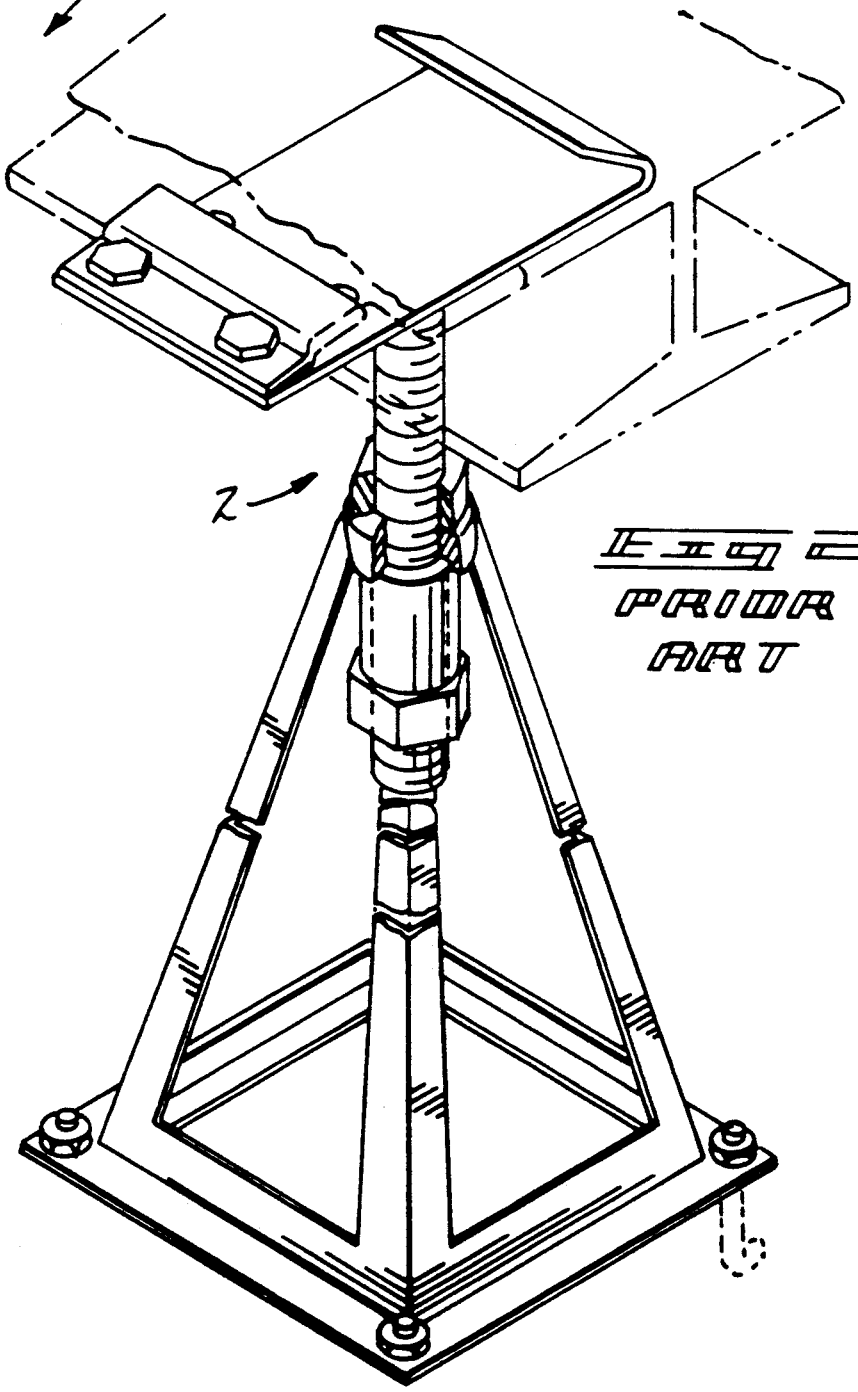
Fig 2 PRIOR ART
FIG. 2 is an isometric illustration of a further example of a prior art trailer anchor structure.

FIG. 1 illustrates a prior art structure, as exemplified in the U.S. Pat. No. 4,272,933, wherein the structure 1 includes opposed jaws securing a trailer or mobile home support beam and in turn mounting that support beam to an adjustable chain link tether that in turn is secured to a cementious base. FIG. 2 illustrates a further prior art structure 2, as exemplified in the U.S. Pat. No. 4,882,887, wherein a plate member receives an anchor frame therewithin, and the plate member includes a clamping jaw structure that in turn is mounted to an externally threaded post adjustably mounted within an internally threaded socket.

More specifically, the trailer anchor apparatus 10 of the instant invention essentially comprises a "U" shaped base 11, including a right leg 12 spaced from and parallel a left leg 13, each orthogonally mounted to opposed distal ends of a base leg 14. The respective right, left, and base legs include respective right leg bores 12*a*, left leg bores 13*a*, and base leg bores 14*a* directed therethrough, whereupon mounting of the "U" shaped base 11 within a cementious casing (not shown) such as in a subterranean orientation, the various bores enhance securement of the "U" shaped base 11 in a fixed orientation relative to that column.

Figure 3:
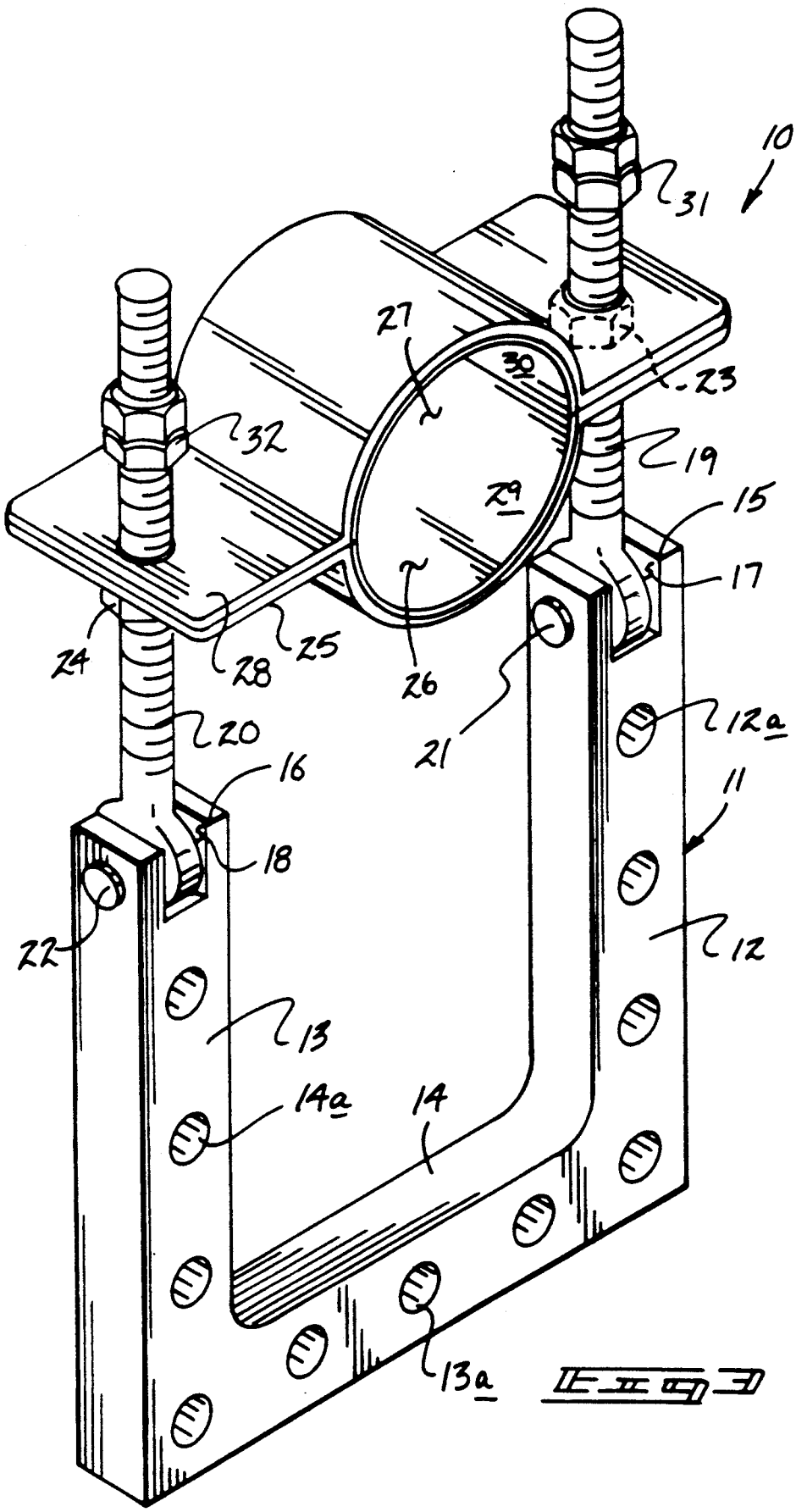
FIG. 3 is an isometric illustration of the instant invention.
Figure 4:
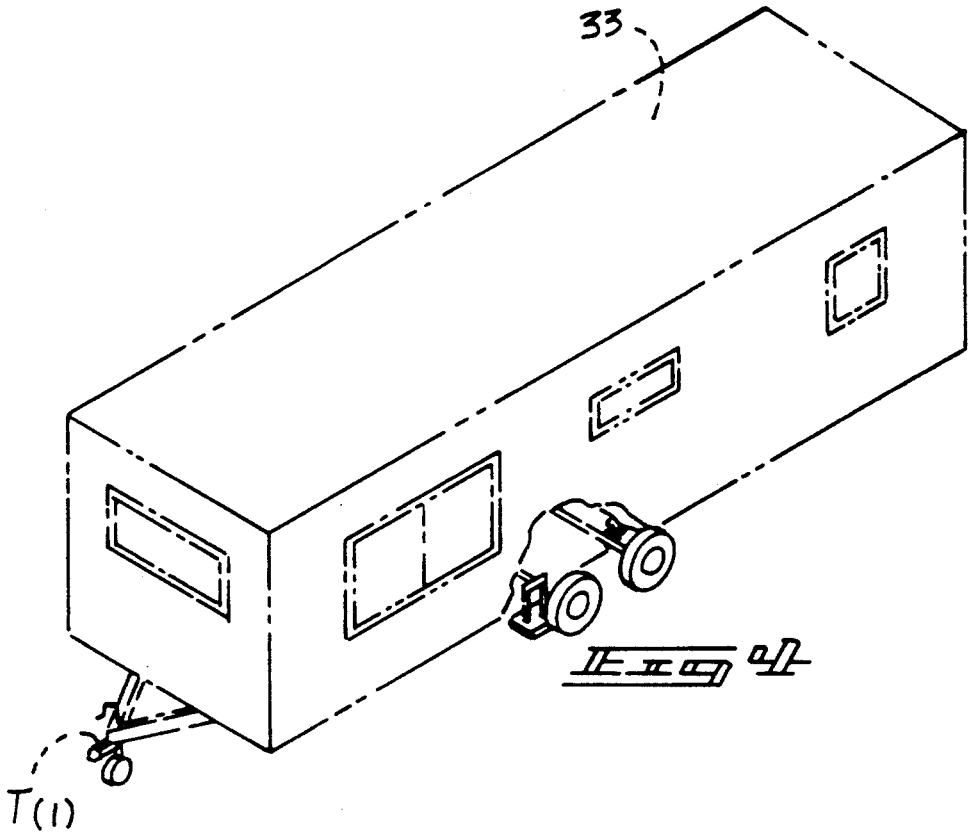
FIG. 4 is an isometric illustration of a typical trailer or mobile home structure utilized in cooperation with the instant invention.
Figure 5:
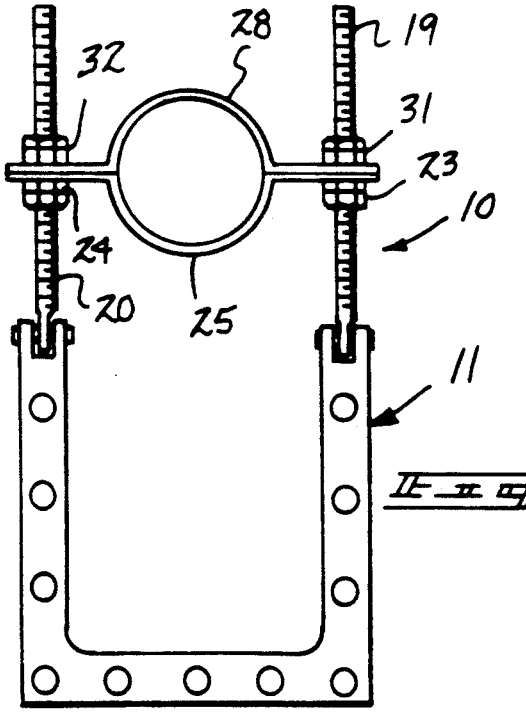
FIG. 5 is an orthographic front view of the invention, taken in elevation.
Figure 6:
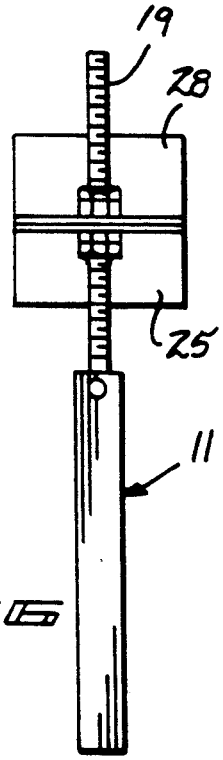
FIG. 6 is an orthographic side view of the invention, taken in elevation.
Figure 11:
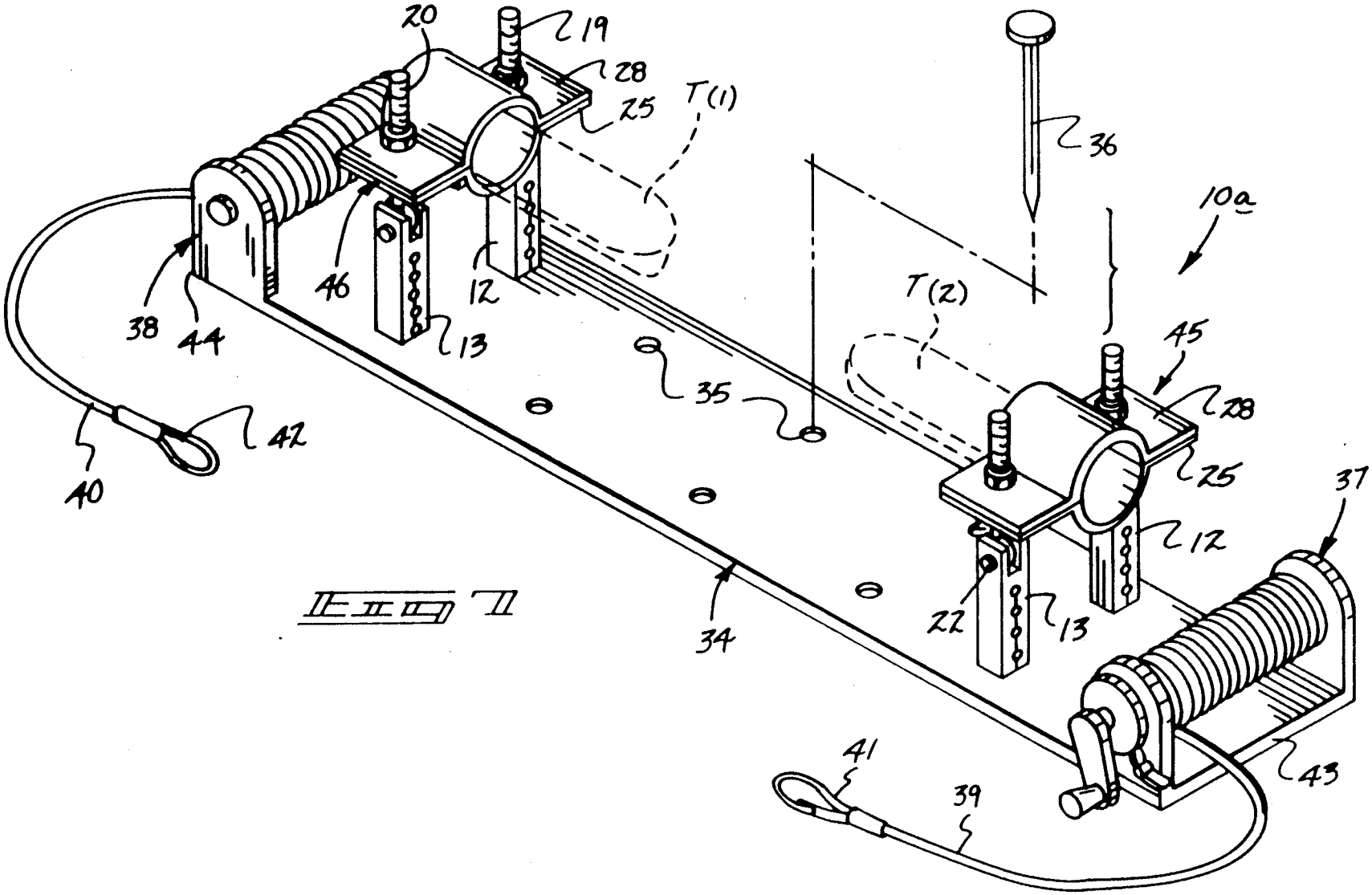

The respective right and left legs 12 and 13 terminate in upper bifurcated right and left leg end portions 15 and 16 respectively, each including respective right and left slots 17 and 18 that are arranged in a parallel relationship. A right externally threaded pivot leg 19 and a left externally threaded pivot leg 20 are in turn pivotally mounted to respective right and left bifurcated end portions 15 and 16 at lower distal ends of the respective right and left legs 19 and 20. A respective right and left axle 21 and 22 is orthogonally directed through the respective right and left slots 17 and 18 pivotally mounting the lower terminal ends of the right and left pivot legs 19 and 20 to the respective right and left leg end portions 15 and 16, as illustrated in FIG. 3. A right lower internally threaded nut member 23 and a left lower internally threaded nut member 24 are each mounted at a selected orientation along the respective right and left pivot legs 19 and 20, each supporting the lower and upper support plates 25 and 28 thereon. The lower support plate 25 includes a semi-cylindrical central lower recess 26, while the upper support plate 28 includes a semi-cylindrical central upper recess 27, wherein the recesses are arranged coextensive and in contiguous communication relative to one another in the concentric relationship to define a cylindrical bore to receive the associated trailer tongue, such as the trailer tongue "T1" of the trailer 33 of a type as illustrated in FIG. 4 for example. To minimize marrying and abrasion of the trailer tongue "T1", a lower semi-cylindrical resilient liner 29 and an upper semi-cylindrical resilient liner 30 are each mounted coextensively within the respective lower and upper recesses 26 and 27. A right upper internally threaded fastener 31 and a left upper internally threaded fastener 32 are each mounted above the support plates in cooperation with the lower fasteners to arrest and secure the support plates in a desired predetermined height along the pivot legs.

FIG. 7 illustrates a modified apparatus 10*a*, wherein a central support plate 34 includes a first and second anchor member 45 and 46 arranged in a parallel relationship relative to one another, with the axes of the respective cylindrical cavities defined by the upper and lower support plates 28 and 25 respectively arranged in a generally parallel relationship. The respective right and left legs 12 and 13 of the associated first and second anchor members 45 and 46 are orthogonally mounted to the underlying support plate 34. A first winch 37 positioned adjacent a support plate first distal 43 is arranged parallel to a second winch 38 mounted adjacent the support plate's second distal end 44, with the winches arranged parallel relative to themselves and to the associated members, wherein each of the first and second winches 37 and 38 include respective first and second winch cable 39 and 40 wound about a respective drum and the first and second cables terminating in respective first and second cable clasps 41 and 42 to permit securement of the cables about various supporting structure, such as trees, utility poles, and further anchor posts to enhance stability of the organization in use. It is understood that the central support plate 34 may utilize mounting spikes 36 directed through support plate apertures 35 alone to secure the plate to an underlying support surface, or alternatively position the support plate, as well as the right and left legs 12 and 13 within a cementious encasing for purposes as discussed above to securely anchor the organization within a subterranean orientation. In this manner, confronting trailer tongues "T1" and "T2" may be utilized in confronting relationship thereby permitting a plurality of trailers relative to one another in a longitudinally aligned relationship effecting displacement of one of the trailers dependent upon displacement of the second and thereby affording greater stability to the plurality of trailers mounted to the single support plate and essentially tying the mass of the plurality of trailers together in a single organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A trailer anchor apparatus, comprising, a first anchor member, the first anchor member including a right leg spaced from and parallel to a left leg, and the right leg including a bifurcated right leg upper end portion and the left leg including a bifurcated left leg upper end portion, wherein the right leg upper end portion includes a right slot and the left leg upper end portion includes a left slot, and a right externally threaded pivot leg pivotally mounted to the right slot and a left externally threaded pivot leg pivotally mounted to the left slot, and a lower support plate, and the right pivot leg and the left pivot leg directed through the lower support plate, and an upper support plate mounted contiguously and coextensively to the lower support plate, with the right pivot leg and the left pivot leg directed through the upper support plate, wherein the lower support plate includes a central lower recess and the upper support plate includes an upper recess, wherein the upper recess and the lower recess are arranged in a coextensive and concentric relationship relative to one another to receive a trailer tongue therethrough.

2. An apparatus as set forth in claim 1 wherein the right slot is arranged parallel to the left slot and the right pivot leg includes a right lower internally threaded nut member positioned below the lower support plate, and the left pivot leg includes a left internally threaded lower threaded nut member mounted below the lower support plate, and an upper right internally threaded fastener mounted to the right pivot leg above the upper support plate, and an internally threaded fastener mounted to the left pivot leg above the upper support plate, wherein the right lower internally threaded nut member and the right upper internally threaded fastener and the left lower internally threaded nut member and the left internally threaded fastener clamp the lower support plate and the upper support plate therebetween.

3. An apparatus as set forth in claim 2 wherein the lower recess and the upper recess include a respective lower resilient liner and upper resilient liner therewithin.

4. An apparatus as set forth in claim 3 wherein the right leg and the left leg are integrally and orthogonally mounted to a central support plate, and the support plate further includes a second anchor member, wherein the second anchor member includes a second right leg and a second left leg, wherein the second anchor member is arranged in a parallel relationship relative to the first anchor member, and the second right leg and the second left leg are arranged parallel to the right leg and the left leg of the first anchor member, and a second right pivot leg and a second left pivot leg pivotally mounted to the respective second right leg and the second left leg, and the second right pivot leg and the second left pivot leg including a second lower support plate and a second upper support plate, wherein the second lower support plate and the second upper support plate includes a respective second lower recess and a second upper recess arranged in a coextensive and concentric relationship relative to one another, and the second lower recess and the second upper recess define a second axis and the lower recess and the upper recess of the first and second member define a first axis, wherein the first axis is arranged parallel relative to the second axis.

5. An apparatus as set forth in claim 4 wherein the support plate includes a first distal end positioned in a spaced adjacency to the first anchor member, and a second distal end positioned in spaced adjacency to the second anchor member, and the first distal end includes a first winch and the second distal end includes a second winch, wherein the first winch includes a first winch cable and the second winch includes a second winch cable, and the first winch cable includes a first cable clasp and the second winch cable includes a second cable clasp.

6. An apparatus as set forth in claim 5 wherein the central support plate includes a plurality of apertures directed therethrough, and at least one of said apertures includes a mounting spike for projection through the at least one said aperture.

* * * * *